US009348269B1

(12) United States Patent
Bridges et al.

(10) Patent No.: US 9,348,269 B1
(45) Date of Patent: May 24, 2016

(54) IMAGE TRANSFER PRODUCT INCLUDING A PHASE CHANGE MATERIAL

(71) Applicant: Day International, Inc., Plymouth, MI (US)

(72) Inventors: Scott Bridges, Asheville, NC (US); Samuel R. Shuman, Fletcher, NC (US); Peter Asplund, Arden, NC (US)

(73) Assignee: Day International, Inc., Plymouth, MI (US)

( * ) Notice: Subject to any disclaimer, the term of this patent is extended or adjusted under 35 U.S.C. 154(b) by 0 days.

(21) Appl. No.: 14/625,174

(22) Filed: Feb. 18, 2015

(51) Int. Cl.
*G03G 15/16* (2006.01)
*B41F 7/10* (2006.01)

(52) U.S. Cl.
CPC ..... *G03G 15/162* (2013.01); *B41F 7/10* (2013.01); *G03G 15/1625* (2013.01)

(58) Field of Classification Search
CPC ..... G03G 15/162; G03G 15/1625; B41F 7/10
See application file for complete search history.

(56) References Cited

U.S. PATENT DOCUMENTS

| | | | | |
|---|---|---|---|---|
| 4,521,095 | A * | 6/1985 | Mayer | 399/333 |
| 4,770,928 | A * | 9/1988 | Gaworowski et al. | 442/221 |
| 4,812,357 | A * | 3/1989 | O'Rell et al. | 442/224 |
| 8,328,349 | B2 | 12/2012 | Hook et al. | |
| 2003/0033948 | A1 * | 2/2003 | Buono et al. | 101/395 |
| 2005/0227047 | A1 | 10/2005 | Sutter et al. | |
| 2009/0202936 | A1 * | 8/2009 | Morelissen | 430/124.32 |
| 2012/0103214 | A1 | 5/2012 | Stowe et al. | |
| 2012/0297999 | A1 | 11/2012 | Beier et al. | |

FOREIGN PATENT DOCUMENTS

| | | | |
|---|---|---|---|
| EP | 2036720 | B1 | 6/2010 |
| EP | 2190667 | B1 | 8/2011 |
| EP | 2190672 | B1 | 10/2011 |
| EP | 2190673 | B1 | 10/2011 |
| EP | 2447068 | A1 | 10/2011 |
| JP | 2005103754 | A | 4/2005 |

* cited by examiner

*Primary Examiner* — Betelhem Shewareged
(74) *Attorney, Agent, or Firm* — Dinsmore & Shohl LLP

(57) ABSTRACT

An image transfer product is provided which includes a phase change material in one or more layers of the product to regulate the temperature of the product during printing operations. The image transfer product may be in the form of a printing blanket, printing sleeve, electrophotographic/xerographic transfer blanket, image transfer belt, or roller which includes a print surface layer and at least one layer underlying the printing surface layer. The phase change material may be included in any of the layers of the image transfer product, but is not present at the upper surface of the print surface layer. The phase change material may be in the form of a powder, fibers, capsules, or combinations thereof.

15 Claims, 4 Drawing Sheets

IMAGE TRANSFER PRODUCT INCLUDING A PHASE CHANGE MATERIAL

BACKGROUND OF THE INVENTION

Embodiments described herein relate to an image transfer product such as a printing blanket, printing sleeve, or printing belt, and more particularly, to an image transfer product including a phase change material in one or more layers of the product to regulate the temperature of the product during printing operations.

Image transfer products such as printing blankets, printing sleeves, printing rollers, belts, and the like are used in a number of printing processes, including sheet and web offset lithography, electrophotographic printing, and hybrids of electrophotographic or inkjet printing combined with transfuse printing. The function of the image transfer products is to repeatedly and consistently transfer an image of ink, or solid or liquid toner, onto a substrate such as paper, plastic film, or the like.

Such image transfer products are subjected to various environmental and operational conditions which can affect the temperature of the ink or toner transfer surface. Operation at temperatures which are greater than or less than optimal may adversely affect print quality, ink performance, and image transfer product performance. For example, temperature variations in the print surface of an image transfer product can cause problems with transfer consistency, and consequently, reduce the quality of the image transferred to the substrate. Such temperature variations can be caused by a number of factors including ink or paper piling, the ambient temperature of the image transfer system, substrate variation, printing speed, ink variation, fountain solution variation, nip pressure, printing plate aging, and aging of the image transfer product. Conversely, temperature variations can cause conditions such as ink piling, substrate release, or lack of lubricity, leading to poor performance of the printing system.

In addition to temperature variations, feed variation at transfer nips is also a problem for some image transfer products. By "feed variation," it is meant the relative difference in the actual speed of the substrate versus the press design speed through a transfer nip. A positive feed variation passes the substrate more quickly than the substrate design speed of a particular press, while a negative feed variation passes the substrate more slowly than the substrate design speed of a press.

Various physical properties of the image transfer product can also affect feed behavior. When the feed behavior of the image transfer product is affected by temperature fluctuations, print quality and substrate handling may be adversely affected, resulting in improper web tension, sheet curl, color registration, and uneven print length.

Accordingly, there is a need in the art for an improved image transfer product which is adapted to dampen temperature fluctuations that can occur during printing to improve the consistency and quality of the image transferred to a substrate.

SUMMARY OF THE INVENTION

Embodiments of the invention meet that need by providing an image transfer product such as a tensioned or non-tensioned printing blanket, printing sleeve, image transfer belt or print roller which is used in the transfer of liquid ink, or liquid or solid toner to a substrate. The image transfer product includes a phase change material (PCM) located in one or more layers of the product which is designed to absorb and/or release energy at a beneficial temperature for a particular print process or press. A phase change material is a substance with a high heat of fusion and having a melting point at a specified temperature, which is capable of storing and releasing energy. Phase change materials are capable of latent heat storage as heat is absorbed or released when the material changes from solid to liquid and vice versa.

By incorporating a phase change material into one or more layers of an image transfer product, the temperature, and therefore, compliancy of the image transfer product is stabilized, and the consistency and quality of the images transferred to a substrate are improved.

According to one aspect of the invention, an image transfer product is provided comprising at least a print surface layer and at least one layer underlying the print surface layer, wherein at least one of the layers includes at least one phase change material therein for regulating the temperature of the image transfer product; and wherein the phase change material is not present in the upper surface of the print surface layer.

The phase change material may be provided in the form of a powder, fibers, filled spheres/microcapsules, or a combination thereof. In one embodiment, the image transfer product includes two phase change materials having different melting points. For example, the image transfer product may include a first phase change material having a melting point of about 25° C. and a second phase change material having a melting point of about 30° C.

In one embodiment, the phase change material is used in combination with a thermally conductive agent which allows heat energy to flow into and out of the phase change material and uniformly throughout the transfer product. In one embodiment, the thermal conductivity agent is selected from aluminum oxide, aluminum nitride, boron nitride, and graphite.

The phase change material may be included in both the print surface layer and underlying layer(s), or it may be included only in the layer(s) underlying the print surface layer.

The print surface layer is selected from, but not limited to, nitrile rubber, hydrogenated nitrile butadiene rubber, polysulfide rubber, butyl rubber, EPDM rubber, polyacrylate rubber, thermoplastic and thermosetting polyurethanes, silicones, fluorosilicones, fluoropolymers, and mixtures or alloys thereof.

In one embodiment of the invention, the image transfer product is in the form of a printing blanket including a print surface layer, an elastomeric layer directly underlying the print surface layer, at least one reinforcing fabric layer underlying the print surface layer, and a compressible layer underlying the print surface layer.

In one embodiment, all of the blanket layers include a phase change material therein. In another embodiment, the phase change material is incorporated only in the elastomeric layer directly underlying the print surface layer. In yet another embodiment, the phase change material is incorporated only in the fabric layer.

In one embodiment, the printing blanket includes additional fabric layers, where the phase change material is incorporated only in the fabric layer in closest proximity to the print surface layer. In another embodiment, the printing blanket includes a metal base layer.

In another embodiment, the image transfer product comprises a printing sleeve including a base sleeve comprised of metal, a polymer, or a composite, a print surface layer, and a layer directly underlying the print surface layer. The layer directly underlying the print surface layer may comprise an image reinforcement layer comprising wound cord, a polymeric film, or fabric. The printing sleeve may further include a compressible layer. The phase change material may be incorporated in one or more of these layers.

In yet another embodiment, the image transfer product may be in the form of an electrophotographic or xerographic intermediate transfer blanket including a print surface layer, an elastomeric layer directly underlying the print surface layer, at least one fabric or polymeric layer underlying the print surface layer, and a compressible layer underlying the print surface layer. The phase change material may be included in one or more of these layers.

In yet another embodiment, the image transfer product may be in the form of an electrophotographic or xerographic transfer sleeve including a print surface layer, an image reinforcement layer directly underlying the print surface layer, and a base layer comprised of a metal, a polymer, or a composite. The image reinforcement layer may comprise a wound cord, a polymeric film, or fabric.

In yet another embodiment, the image transfer product comprises a continuous image transfer belt including a print surface layer, a compliant layer, and a base layer, where the phase change material is included in one or more of these layers.

In yet another embodiment, the image transfer product comprises a printing roller including a core, a print surface layer, and an elastomeric layer underlying the printing surface layer. The core may be comprised of a composite or metal material. In this embodiment, the phase change material is preferably incorporated in the elastomeric layer and cavities within the core.

Accordingly, it is a feature of the present invention to provide an image transfer product including a phase change material in one or more layers which allows the temperature of the product to be regulated during operation. Other features and advantages of the invention will be apparent from the following description, the accompanying drawings, and the appended claims.

DETAILED DESCRIPTION OF THE INVENTION

Figure 1:
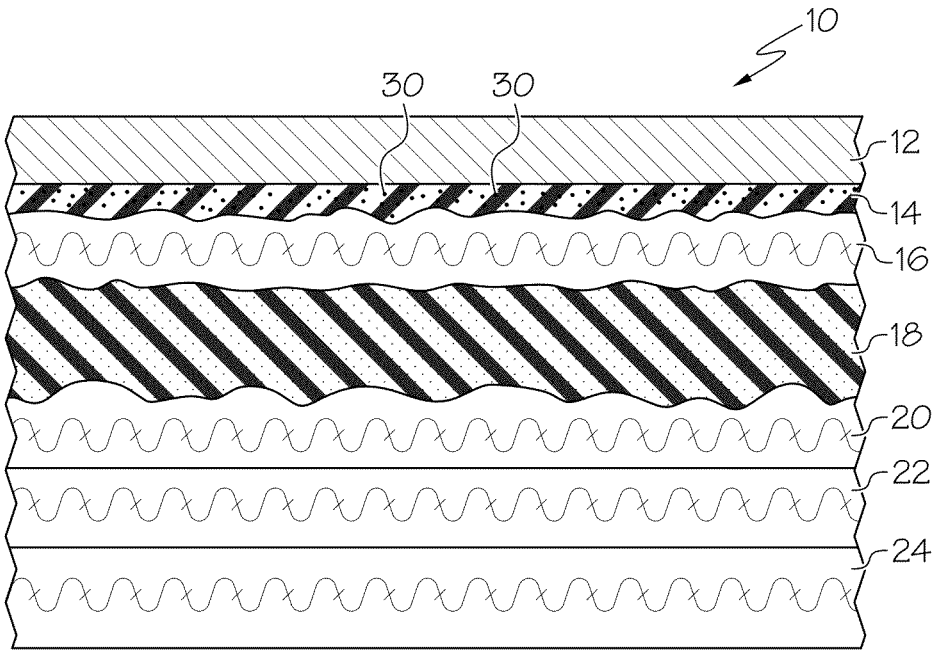
FIG. 1 is a cross-sectional view of a printing blanket construction including a phase change material therein in accordance with an embodiment of the invention.

The use of a phase change material in an image transfer product helps to regulate the temperature of the image transfer product, and in particular, the temperature of the print surface, to provide a consistent temperature for image transfer. For example, if the printing process is running under steady state conditions but the ambient temperature begins to rise, the phase change material will absorb sufficient energy to prevent or delay the increase of the temperature of the print surface of the image transfer product. By maintaining the temperature within a narrow range, the ink, dry toner, or liquid toner image is transferred more consistently. In instances where there is a variation in substrate thickness which could cause heating of the image transfer product, the increased heat produced is absorbed by the phase change material to reduce or delay the temperature effects on image transfer.

The phase change material(s) should be placed as close to the print surface layer as possible in order to stabilize the temperature of the print face as this will increase consistency of toner/ink transfer and thereby increase print quality. While the print surface layer may also contain a phase change material, it should be appreciated that the top print face, i.e., the upper surface portion of the print face layer, should not contain any phase change material in order to avoid distortion when the phase change material(s) in underlying layer(s) change from liquid to solid form and vice versa. Thus, the top surface of the print face layer should have a minimum thickness which does not contain a phase change material in order to remain flat during phase changes. Preferably, the portion of the print face layer which does not contain a phase change material should be at least two times the diameter of the largest capsules/particles of phase change material. For example, if the layer just below the print face layer contains phase change particles having a diameter of 25 micrometers, the top surface of the print face layer should have at least 50 micrometers of thickness containing no phase change materials.

The phase change materials may be in the form of fibers having an encapsulated PCM core, microcapsules, or a powder comprising fine particles/granules of phase change material. The image transfer product may include any combination of these phase change materials in one or more of its layers. For example, where the phase change material comprises fibers, it may be incorporated in the fiber, fabric or wound cord layer of an image transfer product. Such phase change fibers may be incorporated into fabrics, for example, by twisting them into the threads or yarns of the fabric prior to weaving. Alternatively, the phase change materials may be added in place of certain warp or fill yarns as long as they do not prevent the resulting fabric from meeting its mechanical specifications.

Where the phase change material comprises microcapsules, it may be added to the microspheres in a compressible layer. Where the phase change material is in powder form, i.e., fine particles/granules, it may be included in elastomer layers. The microencapsulated and particulate phase change materials may be added into image transfer product layers by milling into rubber materials, for example, by mixing with liquid forms of elastomers such as dissolved rubber/solvent liquids or liquid silicones prior to curing and solidification. Fabric layers may also be infused with or coated with phase change materials in microencapsulated form by methods such as dip coating.

Examples of suitable image transfer product constructions and layer compositions are described in commonly assigned U.S. Pat. Nos. 4,015,046, 4,770,928, 6,205,920, and 6,703,095, the disclosures of which are incorporated herein by reference.

Depending on the type of image transfer product, all three forms of a phase change material may be incorporated in the same image transfer product.

Suitable phase change materials for use in embodiments of the image transfer product include microencapsulated phase change materials commercially available from Microtek Laboratories, Inc., fiber phase change materials commercially available from Outlast Technologies LLC, and powder phase change materials commercially available from Rubitherm GmbH under the designation RUBITHERM®. For example, a tensioned or non-tensioned offset transfer blanket may include granulated (PCM28) or microencapsulated (MPCM28) phase change materials from Microtek having a melting temperature of 28° C. A transfuse transfer product for liquid or solid toner transfer may utilize a solid-solid PCM powder (X120) available from PCM Products Ltd. to maintain a consistent temperature of 120° C. for thermal transfer. Such phase change materials may also be incorporated into image transfer products comprising belts or cylindrical sleeves.

The phase change materials may be used in combination with thermally conductive agents including, but not limited to, aluminum oxide, aluminum nitride, boron nitride, and graphite. The thermal conductivity agents enhance the performance of the phase change materials by enhancing the flow of heat energy into and out of the PCMs, helping to maintain a uniform temperature throughout the image transfer product. The thermal conductivity agent(s) may be provided in the form of powders which are incorporated in the product layers with the phase change materials.

Referring now to FIG. 1, one embodiment of an image transfer product is shown in the form of an offset printing blanket 10. Typically, the printing blanket will comprise a print surface layer (about 0.008 to 0.20 inches thick), a compressible layer (about 0.010 to 0.030 inches thick), one or more elastomeric layers (each about 0.001 to 0.010 inches thick), and one or more underlying fabric layers (each about 0.008 to 0.016 inches thick). In the embodiment shown, the blanket includes a print face layer 12, an elastomeric layer 14 directly underlying the print surface layer, a fabric layer 16, a compressible layer 18, and fabric layers 20, 22, and 24. In the embodiment shown, a phase change material 30 is incorporated just below the print surface layer in elastomeric layer 14. In the embodiment shown, the elastomeric layer 14 preferably comprises a flexible adhesive rubber formulation.

Figure 2:
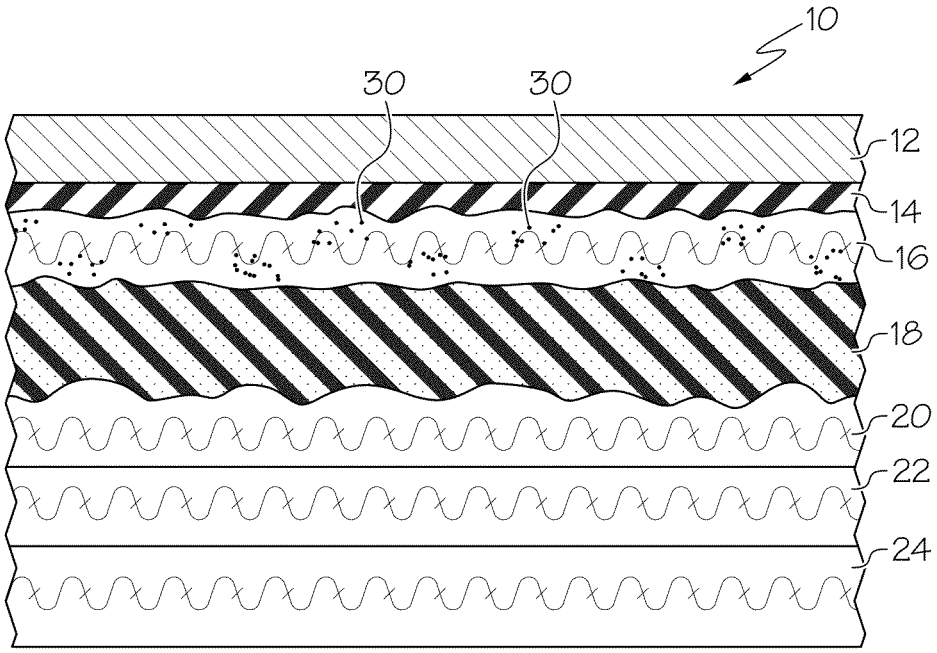
FIG. 2 is a cross-sectional view of a printing blanket construction including a phase change material in accordance with another embodiment of the invention.

Referring now to FIG. 2, another embodiment of an image transfer product is shown comprising a printing blanket 10 in which the phase change material 30 is included only in the fabric layer 16 which is closest to the print surface layer 12.

Figure 3:
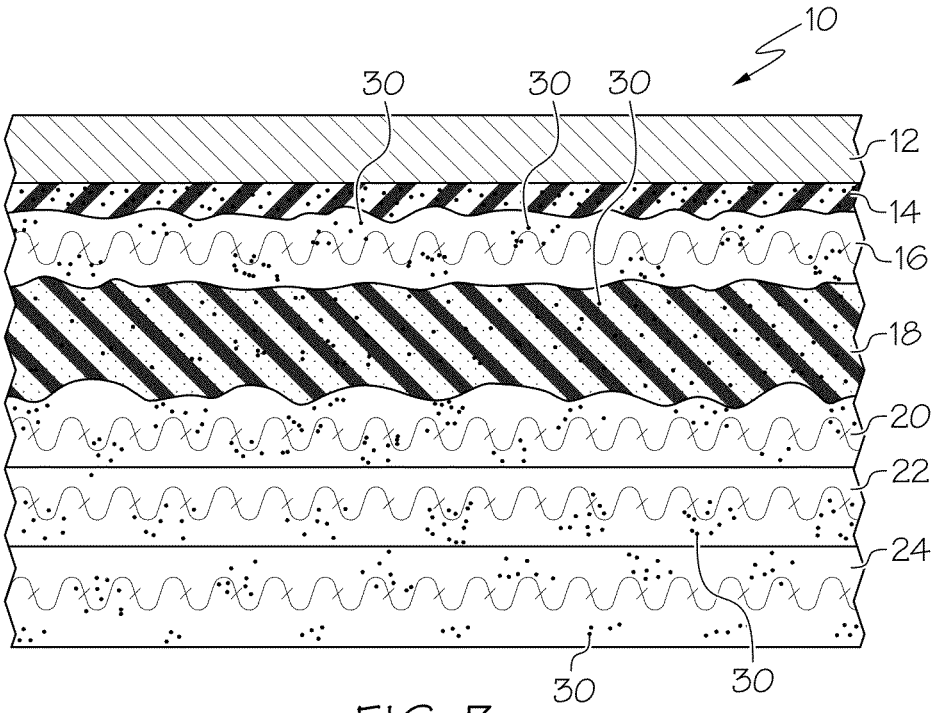
FIG. 3 is a cross-sectional view of a printing blanket construction including a phase change material therein in accordance with another embodiment of the invention.

FIG. 3 illustrates yet another embodiment of an image transfer product comprising a printing blanket 10 in which the phase change material 30 is incorporated into each of the blanket layers, including a portion of the printing surface layer 12. In this embodiment, the phase change material may be provided in different forms as described above, depending on the layer composition. The phase change materials used may also have varying ranges of melting points so as to maintain the desired temperature for the image transfer product and/or print surface layer.

Figure 4:
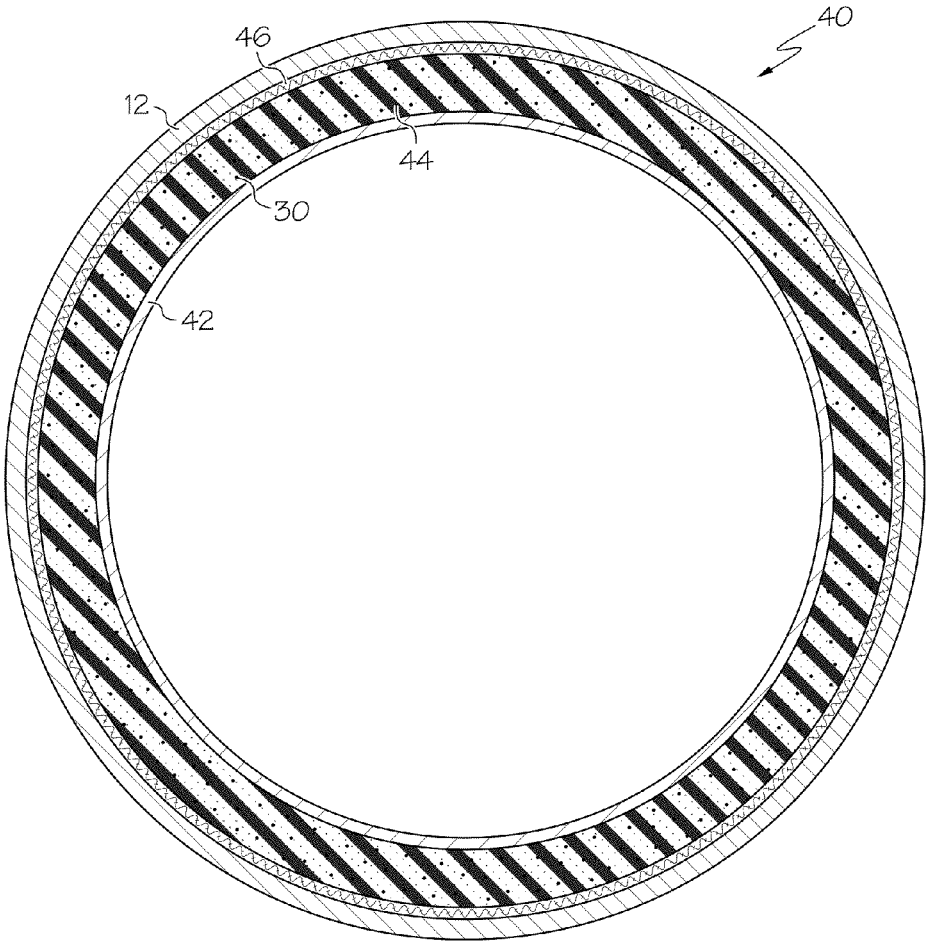
FIG. 4 is a cross-sectional view of a printing sleeve including a phase change material therein in accordance with another embodiment of the invention.

FIG. 4 illustrates another embodiment of an image transfer product comprising a printing sleeve 40. In the embodiment shown, the sleeve includes a base layer 42, an optional compressible layer 44 containing phase change material 30, a print surface layer 12, and a layer 46 directly underlying the print surface layer which may be comprised of fabric, filaments/wound cord, or a polymeric film. In one embodiment, the sleeve may be in the form of an electrophotographic or xerographic transfer sleeve, where the layer underlying the print surface layer functions as an image reinforcement layer.

Figure 5:
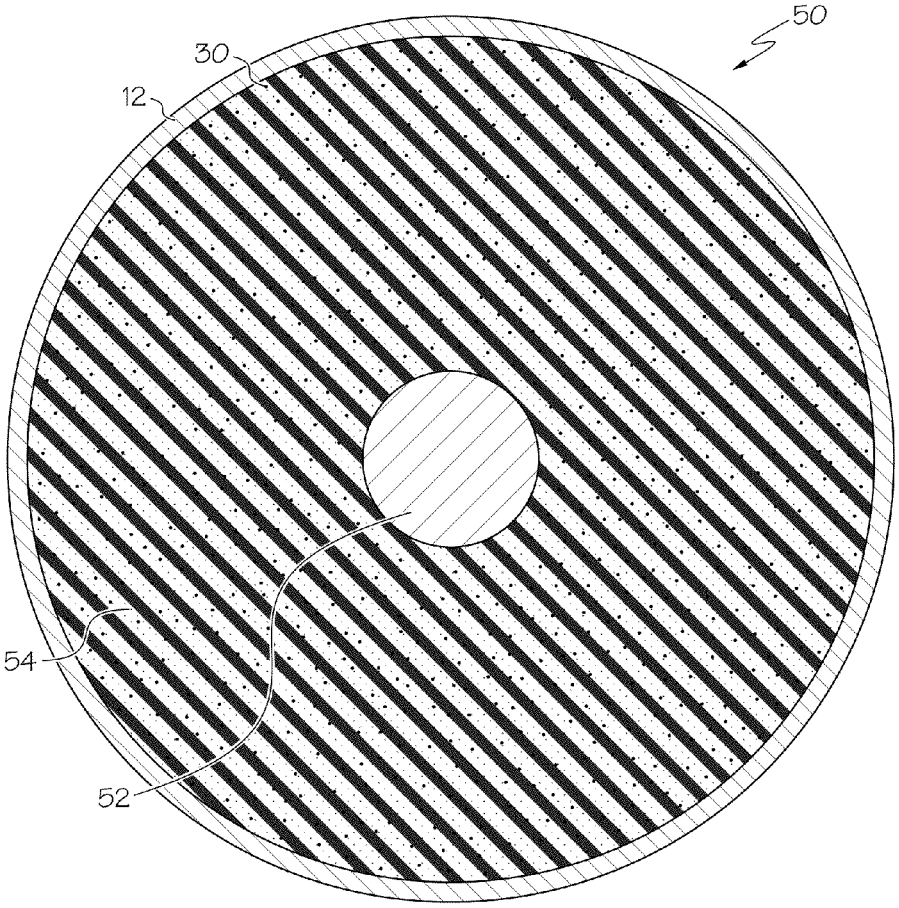
FIG. 5 is a cross-sectional view of a printing roller including a phase change material therein in accordance with another embodiment of the invention.

FIG. 5 illustrates another embodiment of an image transfer product comprising a print roller 50 which includes a phase change material therein. As shown, the print roller includes an inner metal shaft 52, an elastomer layer 54 containing a phase change material 30, and an outer print surface layer 12.

Figure 6:
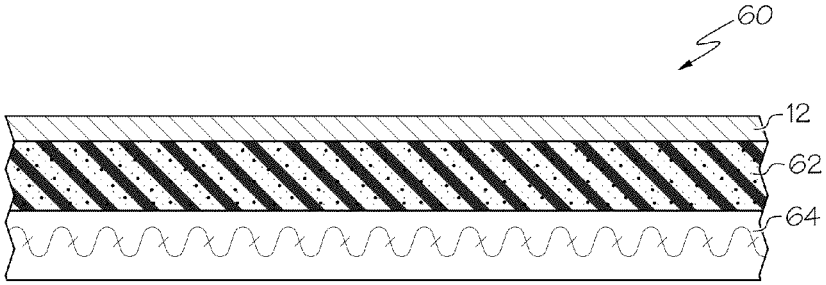
FIG. 6 is a cross-sectional view of an image transfer belt including a phase change material therein in accordance with another embodiment of the invention.

FIG. 6 illustrates yet another embodiment of the image transfer product comprising an image transfer belt 60 including a print surface layer 12, a compliant layer 62 underlying the print surface layer, and a base layer 64. The compliant layer may comprise silicones, rubbers, polyurethanes, fluorosilicones, fluorocarbons, EPDM, ethylene-propylene copolymers, elastomers, encapsulated microspheres, and blends thereof. The base layer may comprise a reinforcing layer of fabric or film. Where the base layer comprises a film, suitable polymers include, but are not limited to, polyester, polyethylene, polypropylene, polyethylene terephthalate, polyethylene naphthalate, polyethylene imine, polyphenylene sulfide, nylon, polyimide, polycarbonate, and polyetherimide. The belt may further include a compressible layer (not shown). In the embodiment shown, the phase change material 30 is included in the compliant layer 62. A phase change material may also be present in the base layer when the layer comprises fabric. The image transfer belt as shown may also include electrically conductive materials therein so that it may function in an electrophotographic/xerographic print process.

As described above, the melting points of the phase change materials may vary, depending on the particular image transfer product in which they are incorporated and the press or print engine where they will operate. For example, when the phase change material(s) are used in an offset printing blanket or sleeve, the preferred melting point is between about 18° C. to 45° C., and most preferably, about 30° C. Examples of phase change materials having this melting point range include MPCM-28D (available from Microtek) and Rubitherm® PX31.

It should be appreciated that if more than one phase change material is used in a product, the melting points of such materials may be chosen to provide consistent temperature control under varying conditions.

For an electrophotographic blanket or image transfer belt, the phase change material(s) preferably have a melting point of between about 18 to 35° C., and more preferably, about 25° C. Examples of suitable phase change materials having melting points in this range include Rubitherm® RT25 or Microtek MPCM24.

For image transfer products used on inkjet hybrid or liquid toner presses, the operating temperature will fluctuate with each print cycle/image transfer product (ITP) revolution. The image transfer product typically picks up the image at relatively low temperatures of about 100° C. (via inkjet or electrostatic transfer), then rapidly heats it on the image transfer product to a tack or melt point of about 160° C. for transfer to the intended substrate through a nip. Two different phase change materials may be added to stabilize these upper and lower temperatures for more consistent transfers at each point. For example, Rubitherm® RT90HC and PCM-X165 (available from PCM Products Ltd.) may be used in combination.

It should be appreciated that for each image transfer system such as an offset printing press, there is a typical operating temperature, such that blankets produced for a particular press can be designed to function at a specific operating temperature. The melting points of the phase change materials may be selected for a blanket which operates in a particular operating range so as to provide optimal temperature control. The same consideration will apply to other types of image transfer systems which have their own respective operating temperatures or dual temperatures as described above with regard to transfuse blankets.

It should also be appreciated that the image transfer products described herein may be constructed according to conventional methods known in the art and may vary in their layer structure.

Having described the invention in detail and by reference to preferred embodiments thereof, it will be apparent that modifications and variations are possible without departing from the scope of the invention.

What is claimed is:

1. An image transfer product comprising at least a print surface layer and at least one layer underlying said print surface layer, wherein at least one of said layers includes at least one phase change material having a melting point of from about 18° C. to 35° C. therein for regulating the temperature of said image transfer product; wherein said phase change material is not present in the upper surface of said print surface layer.

2. The image transfer product of claim 1 wherein said at least one phase change material is in the form of a powder, fibers, filled spheres/microcapsules, or a combination thereof.

3. The image transfer product of claim 1 including two phase change materials having different melting points.

4. The image transfer product of claim 1 including a thermal conductivity agent.

5. The image transfer product of claim 4 wherein said thermal conductivity agent is selected from the group consisting of aluminum oxide, aluminum nitride, boron nitride, and graphite.

6. The image transfer product of claim 1 wherein said phase change material is included in each layer of said image transfer product.

7. The image transfer product of claim 1 wherein said phase change material is included only in the layer underlying said print surface layer.

8. The image transfer product of claim 1 wherein said printing surface layer is selected from the group consisting of nitrile rubber, hydrogenated nitrile butadiene rubber, polysulfide rubber, butyl rubber, EPDM rubber, polyacrylate rubber, thermoplastic and thermosetting polyurethanes, silicones, fluorosilicones, fluoropolymers, and mixtures or alloys thereof.

9. The image transfer product of claim 1 comprising an electrophotographic or xerographic transfer blanket including said print surface layer, an elastomeric layer directly underlying said print surface layer, at least one fabric or polymeric layer underlying said print surface layer, and a compressible layer underlying said print surface layer.

10. The image transfer product of claim 9 comprising an image transfer belt including said print surface layer, a compliant layer underlying said print surface layer, and a base layer underlying said print surface layer.

11. The image transfer product of claim 1 comprising an electrophotographic or xerographic transfer sleeve including a print surface layer, an image reinforcement layer directly underlying said print surface layer, and a base layer comprised of metal, a polymer, or a composite.

12. The image transfer product of claim 11 wherein said image reinforcement layer comprises wound cord, a polymeric film, or fabric.

13. The image transfer product of claim 1 comprising a print roller including a cylindrical core and an elastomeric layer underlying said printing surface layer.

14. The image transfer product of claim 9 in which one or more of said layers in addition to said print layer includes a phase change material.

15. The image transfer product of claim 11 in which one or more of said layers in addition to said print layer includes a phase change material.

* * * * *